US010074305B2

(12) United States Patent
Choi et al.

(10) Patent No.: US 10,074,305 B2
(45) Date of Patent: Sep. 11, 2018

(54) PIXEL, ORGANIC LIGHT EMITTING DISPLAY DEVICE INCLUDING THE PIXEL, AND METHOD OF DRIVING THE PIXEL

(71) Applicant: SAMSUNG DISPLAY CO., LTD., Yongin-si, Gyeonggi-do (KR)

(72) Inventors: Yang Hwa Choi, Yongin-si (KR); Keum Nam Kim, Yongin-si (KR); Dong Woo Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/232,698

(22) Filed: Aug. 9, 2016

(65) Prior Publication Data

US 2017/0061880 A1 Mar. 2, 2017

(30) Foreign Application Priority Data

Aug. 27, 2015 (KR) ..... 10-2015-0121004

(51) Int. Cl.
*G09G 3/30* (2006.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2310/08* (2013.01); *G09G 2320/045* (2013.01)

(58) Field of Classification Search
CPC ..... G09G 3/3233; G09G 3/3258
USPC ..... 345/76–82
See application file for complete search history.

(56) References Cited

U.S. PATENT DOCUMENTS 7,812,796 B2 10/2010 Jung
2011/0157126 A1* 6/2011 Chung ..... G09G 3/3233 345/211
2016/0086546 A1* 3/2016 Noh ..... G09G 3/3258 345/80

FOREIGN PATENT DOCUMENTS

KR 10-1279115 B1 6/2013

* cited by examiner

*Primary Examiner* — Roy P Rabindranath
(74) *Attorney, Agent, or Firm* — Lewis Roca Rothgerber Christie LLP

(57) ABSTRACT

A pixel includes a driving transistor including a gate connected to a first node, a first electrode connected to a second node, and a second electrode connected to an OLED, a first transistor configured to receive a first emission control signal and connected between a first power source and the second node, a second transistor configured to receive a scan signal and connected between the first and second nodes, a third transistor configured to receive the scan signal and including a first electrode configured to receive a data voltage, and a second electrode connected to a third node, a fourth transistor configured to receive a second emission control signal and connected between the third node and the OLED, a fifth transistor configured to receive the scan signal and connected between the OLED and an initializing power source, and a storage capacitor connected between the first node and the third node.

18 Claims, 5 Drawing Sheets

PIXEL, ORGANIC LIGHT EMITTING DISPLAY DEVICE INCLUDING THE PIXEL, AND METHOD OF DRIVING THE PIXEL

CROSS-REFERENCE TO RELATED APPLICATION

This application claims priority to, and the benefit of, Korean Patent Application No. 10-2015-0121004, filed on Aug. 27, 2015, in the Korean Intellectual Property Office, the entire contents of which are incorporated herein by reference in their entirety.

BACKGROUND

1. Field

An embodiment of the present invention relates to a pixel, an organic light emitting display device including the pixel, and a method of driving the pixel.

2. Description of the Related Art

Recently, various display devices that overcome shortcomings of a cathode ray tube (CRT) (e.g., weight and volume) have been developed. Such display devices include a liquid crystal display (LCD), a field emission display, a plasma display panel (PDP), and an organic light emitting display device.

Recently, as demand for organic light emitting display devices with high resolution has increased, research, on the organic light emitting display devices with high resolution has been performed. For high resolution, research is conducted on using n-channel type transistors that have high operation speeds, when compared to p-channel type transistors, and that are advantageous for manufacturing large-area display devices.

SUMMARY

Embodiments of the present invention, relate to a pixel including n-channel type transistors and having a high operation speed, in which a threshold voltage of a driving transistor is internally compensated for by diode-connection, and also relate to an organic light emitting display device including the pixel, and to a method of driving the pixel.

A pixel according to an embodiment of the present invention includes an organic light emitting diode including an anode electrode, and a cathode electrode configured to receive a second power source, and a driving circuit configured to supply a current to the organic light emitting diode, the driving circuit including a driving transistor including a gate electrode electrically connected to a first node, a first electrode electrically connected to a second node, and a second electrode electrically connected to the anode electrode of the organic light emitting diode, a first transistor including a gate electrode configured to receive a first emission control signal, a first electrode configured to receive a first power source, and a second electrode electrically connected to the second node, a second transistor including a gate electrode configured to receive a scan signal, a first electrode electrically connected to the second node, and a second electrode electrically connected to the first node, a third transistor including a gate electrode configured to receive the scan signal, a first electrode configured to receive a data voltage, and a second electrode electrically connected to a third node, a fourth transistor including a gate electrode configured to receive a second emission control signal that is different from the first emission control signal, a first electrode electrically connected to the third node, and a second electrode electrically connected to the anode electrode of the organic light emitting diode, a fifth transistor including a gate electrode configured to receive the scan signal, a first electrode electrically connected to the anode electrode of the organic light emitting diode, and a second electrode configured to receive an initializing power source, and a storage capacitor electrically connected between the first node and the third node.

The driving transistor, and the first, second, third, fourth, and fifth transistors may include n-channel type transistors.

A length of the first emission control signal may be substantially equal to a length of the second emission control signal in a frame period, the frame period may include first to seventh periods, the first emission control signal may have a high level in the first, second, third, and seventh periods, and may have a low level in the fourth, fifth, and sixth periods, the second emission control signal may have a high level in the first, sixth, and seventh periods, and may have a low level in the second, third, fourth, and fifth periods, the scan signal may have a high level in the third and fourth periods, and may have a low level in the first, second, fifth, sixth, and seventh periods, and the organic light emitting diode may be configured to emit light in the first, second, and seventh periods.

The first, second, third, and fifth transistors may be configured to be turned on, and the fourth transistor may be configured to be turned off, in the third period, and the first node may be configured to receive the first power source in the third period.

The second, third, and fifth transistors may be configured to be turned on, and the first and fourth transistors may be configured to be turned off, in the fourth period, the first node and the second node may be configured to be electrically connected so that the driving transistor is diode-connected in the fourth period, and a difference in a voltage level between ends of the storage capacitor may correspond to following EQUATION $$Vstg=(V\text{init}+Vth)-V\text{data}$$

wherein Vstg represents the difference in the voltage level between the ends of the storage capacitor, Vinit represents a voltage level of the initializing power source, Vth represents a threshold voltage of the driving transistor, and Vdata represents a level of the data voltage.

The first and fourth transistors may be configured to be turned on, and the second, third, and fifth transistors may be configured to be turned off, in the seventh period, the third node and the anode electrode of the organic light emitting diode may be configured to be electrically connected in the seventh period, and a level of a current that flows between the first electrode and the second electrode of the driving transistor may correspond to following EQUATION $$Ids=k(Vgs-Vth)^2=k\{(V\text{init}+Vth)-V\text{data}-Vth\}^2=k(V\text{init}-V\text{data})^2$$

wherein Ids represents the level of the current that flows between the first electrode and the second electrode of the driving transistor, k represents a proportional constant, Vgs represents a difference in voltage level between the gate electrode and the second electrode of the driving transistor, Vinit represents a voltage level of the initializing power source, Vth represents a threshold voltage of the driving transistor, and Vdata represents a level of the data voltage.

An organic light emitting display device according to an embodiment of the present invention includes a display panel, and a display panel driver configured to drive the display panel, the display panel including pixels, m (m is a natural number greater than 1) scan lines configured to transmit scan signals to the pixels, (m+1) emission control lines configured to transmit emission control signals to the pixels, and n (n is a natural number) data lines configured to transmit data voltages to the pixels, wherein the display panel driver includes a data driver configured to generate the data voltages based on received image signals, and a signal driver configured to generate the scan signals and the emission control signals, wherein a pixel of the pixels that is at an ith (i is a natural number less than or equal to m) row includes an organic light emitting diode including an anode electrode, and a cathode electrode configured to receive a second power source, and a driving circuit configured to supply a current to the organic light emitting diode, the driving circuit including a driving transistor including a gate electrode electrically connected to a first node, a first electrode electrically connected to a second node, and a second electrode electrically connected to the anode electrode of the organic light emitting diode, a first transistor including a gate electrode configured to receive a first emission control signal, a first electrode configured to receive a first power source, and a second electrode electrically connected to the second node, a second transistor including a gate electrode configured to receive a scan signal, a first electrode electrically connected to the second node, and a second electrode electrically connected to the first node, a third transistor including a gate electrode configured to receive the scan signal, a first electrode configured to receive a data voltage, and a second electrode electrically connected to a third node, a fourth transistor including a gate electrode configured to receive a second emission control signal that is different from the first emission control signal, a first electrode electrically connected to the third node, and a second electrode electrically connected to the anode electrode of the organic light emitting diode, a fifth transistor including a gate electrode configured to receive the scan signal, a first electrode electrically connected to the anode electrode of the organic light emitting diode, and a second electrode configured to receive an initializing power source, and a storage capacitor electrically connected between the first node and the third node.

A frame period may include first to seventh periods, an ith emission control signal may have a high level in the first, second, third, and seventh periods, and may have a low level in the fourth, fifth, and sixth periods, wherein an (i−1)th emission control signal may have a high level in the first, sixth, and seventh periods, and may have a low level in the second, third, fourth, and fifth periods, wherein an ith scan signal may have a high level in the third and fourth periods and has a low level in the first, second, fifth, sixth, and seventh periods, and the organic light emitting diode may be configured to emit light only in the first, second, and seventh periods.

The second, third, and fifth transistors may be configured to be turned on, and the first and fourth transistors may be configured to be turned off, in the fourth period, the first node and the second node may be configured to be electrically connected so that the driving transistor is diode-connected in the fourth period, and a difference in a voltage level between ends of the storage capacitor may correspond to following EQUATION $$Vstg=(V\text{init}+Vth)-V\text{data}$$

wherein Vstg represents the difference in the voltage level between the ends of the storage capacitor, Vinit represents a voltage level of the initializing power source, Vth represents a threshold voltage of the driving transistor, and Vdata represents a level of the data voltage.

The first and fourth transistors may be configured to be turned on, and the second, third, and fifth transistors may be configured to be turned off, in the seventh period, the third node and the anode electrode of the organic light emitting diode may be configured to be electrically connected in the seventh period, and a level of a current that flows between the first electrode and the second electrode of the driving transistor may correspond to following EQUATION $$Ids=k(Vgs-Vth)^2=k\{(V\text{init}+Vth)-V\text{data}-Vth\}^2=k(V\text{init}-V\text{data})^2$$

wherein Ids represents the level of the current that flows between the first electrode and the second electrode of the driving transistor, k represents a proportional constant, Vgs represents a difference in voltage level between the gate electrode and the second electrode of the driving transistor, Vinit represents a voltage level of the initializing power source, Vth represents a threshold voltage of the driving transistor, and Vdata represents a level of the data voltage.

The organic light emitting display device may further include a power source supplier configured to generate the first power source and the initializing power source, the display panel may further include first power source lines configured to transmit the first power source to the pixels, and initializing power source lines configured to transmit the initializing power source to the pixels, the pixels may be arranged in a first direction, and in a second direction that intersects the first direction, lengths of the emission control signals may be substantially constant in a frame period, the scan lines and the emission control lines may extend in the first direction, the scan signals or the emission control signals may be sequentially supplied in the second direction in the frame period, and the first power source lines and the initializing power source lines may extend in the second direction.

A first electrode of the first transistor may be electrically connected to one of the first power source lines, and a pixel adjacent the pixel in the ith row in the first direction may be configured to receive the first power source through the first transistor of the pixel in the ith row.

An initializing power source line configured to supply the initializing power source to the pixel in the ith row may be configured to supply the initializing power source to a pixel adjacent the pixel in the ith row in a direction opposite to the first direction.

A structure of the pixel in the ith row may be substantially equal to a structure of a pixel adjacent the pixel in the ith row in the second direction, and an emission control line of the emission control lines may be configured to supply the ith emission control signal to the gate electrode of the first transistor of the pixel in the ith row, and may be configured to supply the ith emission control signal to a gate electrode of a fourth transistor of the pixel adjacent the pixel in the ith row in the second direction.

According to another embodiment of the present invention, there is provided a method of driving a pixel including an organic light emitting diode including an anode electrode, and a cathode electrode configured to receive a second power source, and a driving circuit configured to supply a current to the organic light emitting diode, the driving circuit including a driving transistor including a gate electrode electrically connected to a first node, a first electrode electrically connected to a second node, and a second electrode electrically connected to the anode electrode of the organic light emitting diode, a first transistor including a gate electrode configured to receive a first emission control signal, a first electrode configured to receive a first power source, and a second electrode electrically connected to the second node, a second transistor including a gate electrode configured to receive a scan signal, a first electrode electrically connected to the second node, and a second electrode electrically connected to the first node, a third transistor including a gate electrode configured to receive the scan signal, a first electrode configured to receive a data voltage, and a second electrode electrically connected to a third node, a fourth transistor including a gate electrode configured to receive a second emission control signal that is different from the first emission control signal, a first electrode electrically connected to the third node, and a second electrode electrically connected to the anode electrode of the organic light emitting diode, a fifth transistor including a gate electrode configured to receive the scan signal, a first electrode electrically connected to the anode electrode of the organic light emitting diode, and a second electrode configured to receive an initializing power source, and a storage capacitor electrically connected between the first node and the third node, wherein the method includes supplying the scan signal and the first emission control signal to supply the first power source to the first node, supplying the scan signal to diode-connect the driving transistor, and not supplying the first emission control signal to block the first power source from the driving transistor, and supplying the first emission control signal and the second emission control signal so that the organic light emitting diode emits light.

A length of the first emission control signal may be substantially equal to a length of the second emission control signal in the frame period, and a time at which the first emission control signal starts to be supplied may be later than a time at which the second emission control signal starts to be supplied in the frame period.

The supplying the scan signal to diode-connect the driving transistor, and the not supplying the first emission control signal to block the first power source from the driving transistor, may include turning on the second, third, and fifth transistors, turning off the first and fourth transistors, and electrically connecting the first node and the second node, and a difference in voltage level between ends of the storage capacitor may correspond to following EQUATION $$Vstg=(Vinit+Vth)-Vdata$$

wherein Vstg represents the difference in voltage level between the ends of the storage capacitor, Vinit represents a voltage level of the initializing power source, Vth represents a threshold voltage of the driving transistor, and Vdata represents a level of the data voltage.

The supplying the first emission control signal and the second emission control signal so that the organic light emitting diode emits light may include turning on the first and fourth transistors, turning off the second, third, and fifth transistors, and electrically connecting the third node and the anode electrode of the organic light emitting diode, and a level of a current that flows between the first electrode and the second electrode of the driving transistor may correspond to following EQUATION $$Ids=k(Vgs-Vth)^2=k\{(Vinit+Vth)-Vdata-Vth\}^2=k(Vinit-Vdata)^2$$

wherein Ids represents the level of the current that flows between the first electrode and the second electrode of the driving transistor, k represents a proportional constant, Vgs represents a difference in voltage level between the gate electrode and the second electrode of the driving transistor, Vinit represents a voltage level of the initializing power source, Vth represents a threshold voltage of the driving transistor, and Vdata represents a level of the data voltage.

According to embodiments of the present invention, there are provided a pixel including n-channel type transistors and having a high operation speed, in which a threshold voltage of a driving transistor is internally compensated for by diode-connection, an organic light emitting display device including the pixel, and a method of driving the pixel.

BRIEF DESCRIPTION OF THE DRAWINGS

Example embodiments will now be described more fully hereinafter with reference to the accompanying drawings, wherein.

DETAILED DESCRIPTION

Figure 1:
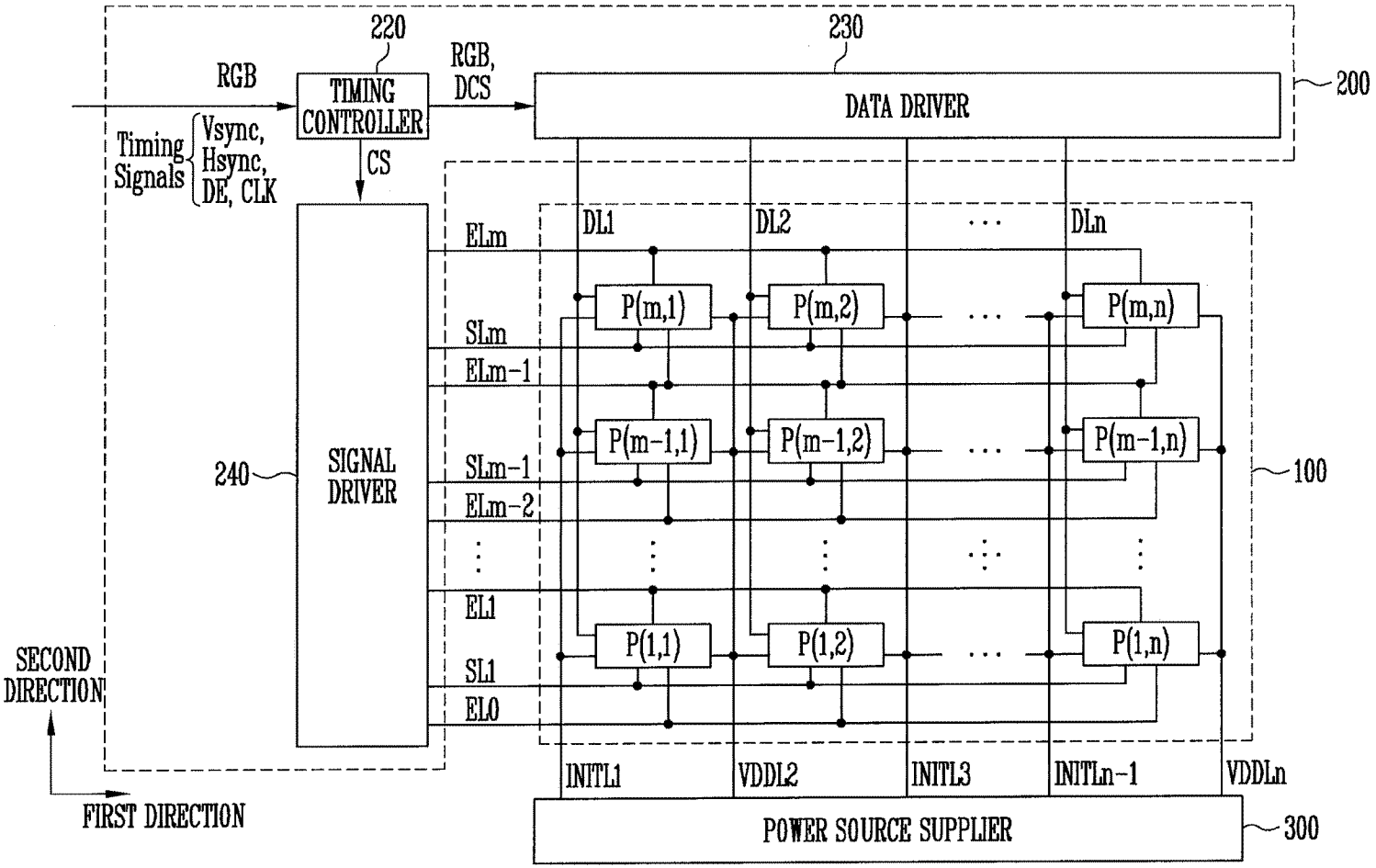
FIG. 1 illustrates an organic light emitting display device according to an embodiment of the present invention.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 illustrates an organic light emitting display device according to an embodiment of the present invention. The organic light emitting display device of the present invention includes a display panel 100, a display panel driver 200 for driving the display panel 100, and a power source supplier 300 for supplying a first power source ELVDD to the display panel 100.

Figure 5:
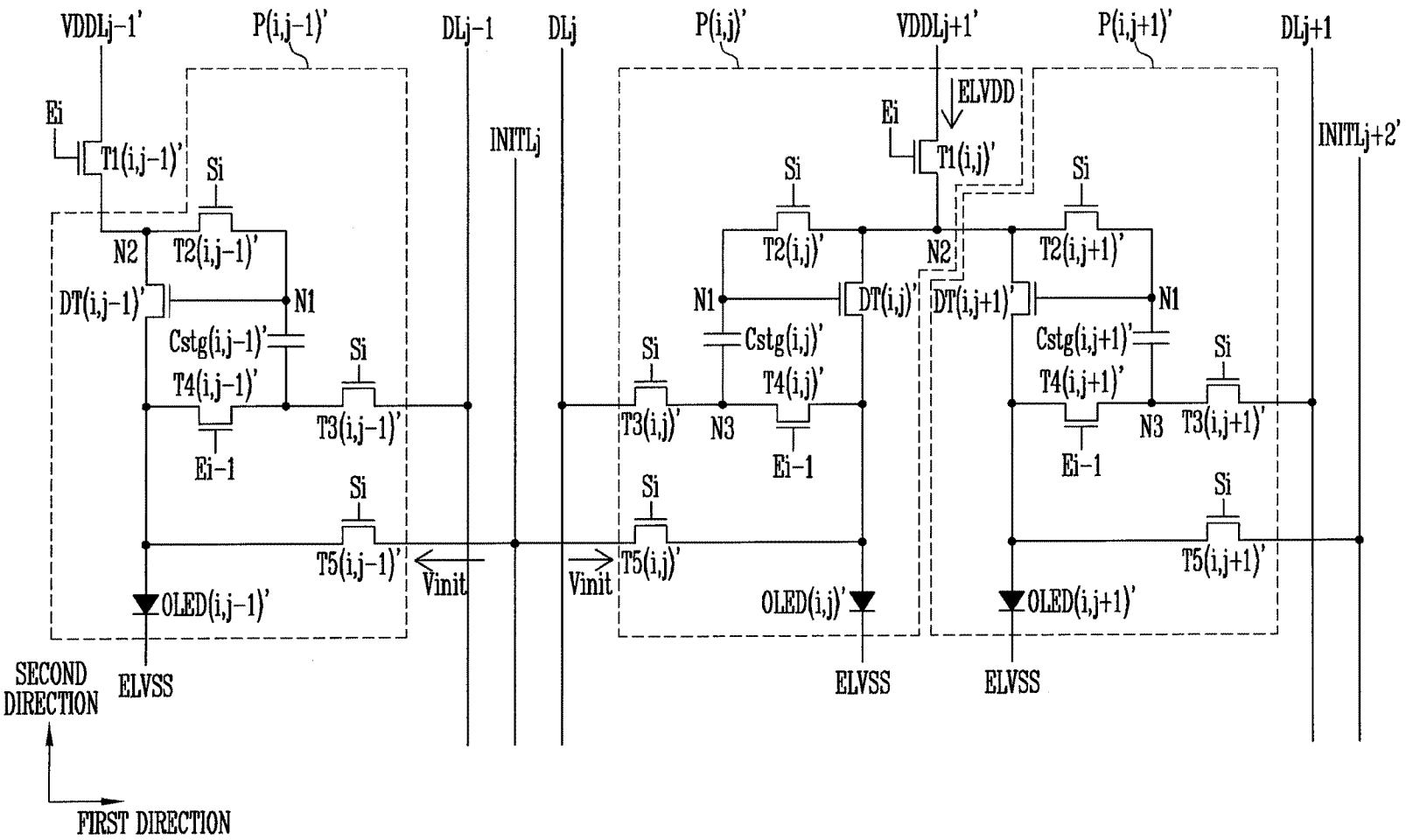
FIG. 5 illustrates pixels of the organic light emitting display device of FIG. 1 sharing a transistor and an initializing power source line.

The display panel 100 includes pixels P(1,1) to P(m,n) (m and n are positive integers), scan lines SL1 to SLm (hereinafter, referred to generically as SL) for transmitting scan signals to the pixels P(1,1) to P(m,n) (hereinafter, referred to generically as P), data lines DL1 to DLn (hereinafter, referred to generically as DL) for transmitting data voltages to the pixels P, emission control lines EL0 to ELm (hereinafter, referred to generically as EL) for transmitting emission control signals to the pixels P, first power source lines VDDL2 to VDDLn (hereinafter, referred to generically as VDDL) for transmitting the first power source ELVDD to the pixels P, and initializing power source lines INITL1 and INITL3 to INITLn−1 (hereinafter, referred to generically as INITL) for transmitting an initializing power source Vinit to the pixels P. In the present embodiment, n may be an even number. In FIG. 5, the first power source lines VDDL and the initializing power source lines INITL will be described in detail.

According to the present embodiment, the pixels P are arranged in a first direction, and in a second direction that intersects the first direction (e.g., are arranged in columns and rows), the scan lines SL and the emission control lines EL may be arranged in the first direction, and the data lines DL may be arranged in the second direction. For example, among the pixels P, a pixel P(i,j) (i is a natural number that is less than or equal to m, and j is a natural number that is less than or equal to n) is electrically connected to a scan line SLi, to emission control lines ELi and ELi−1, to a data line DLj, and to a first power source line VDDLj. A detailed structure of the pixel P(i,j) will be described later with reference to FIG. 2. In addition, the display panel 100 may further include the first power source lines VDDL for supplying the first power source ELVDD to the pixels P and the initializing power source lines INITL for supplying the initializing power source Vinit to the pixels P.

The display panel driver 200 includes a timing controller 220, a data driver 230, and a signal driver 240.

The timing controller 220 receives externally supplied image signals RGB and timing signals. The timing signals may include a vertical synchronizing signal Vsync, a horizontal synchronizing signal Hsync, a data enable signal DE, and a dot clock CLK. The timing controller 220 may output the image signals RGB and a data timing control signal DCS to the data driver 230 based on the image signals RGB and the timing signals, and may output a timing control signal CS to the signal driver 240. The timing control signal CS may include a scan timing control signal and an emission control timing control signal.

The data driver 230 latches image data RGB input from the timing controller 220 in response to the data timing control signal DCS. The data driver 230 includes a plurality of source drive ICs. The source drive ICs may be electrically connected to the data lines DL of the display panel 100 by a chip on glass (COG) process or a tape automated bonding (TAB) process.

The scan driver 240 supplies the scan signals to the scan lines SL and sequentially supplies the emission control signals to the emission control lines EL in response to the timing control signal CS. In addition, in a single frame period, lengths of sections in which the scan signals are supplied correspond to each other, and lengths of sections in which the emission control signals are supplied may correspond to each other (e.g., lengths of the scan signals may be constant, and lengths of the emission control signals may be constant).

The power source supplier 300 generates the first power source ELVDD and the initializing power source Vinit, transmits the first power source ELVDD to the first power source lines VDDL, and may transmits the initializing power source Vinit to the initializing power source lines INITL. According to other embodiments of the present invention, the power source supplier 300 might not generate the initializing power source Vinit.

Figure 2:
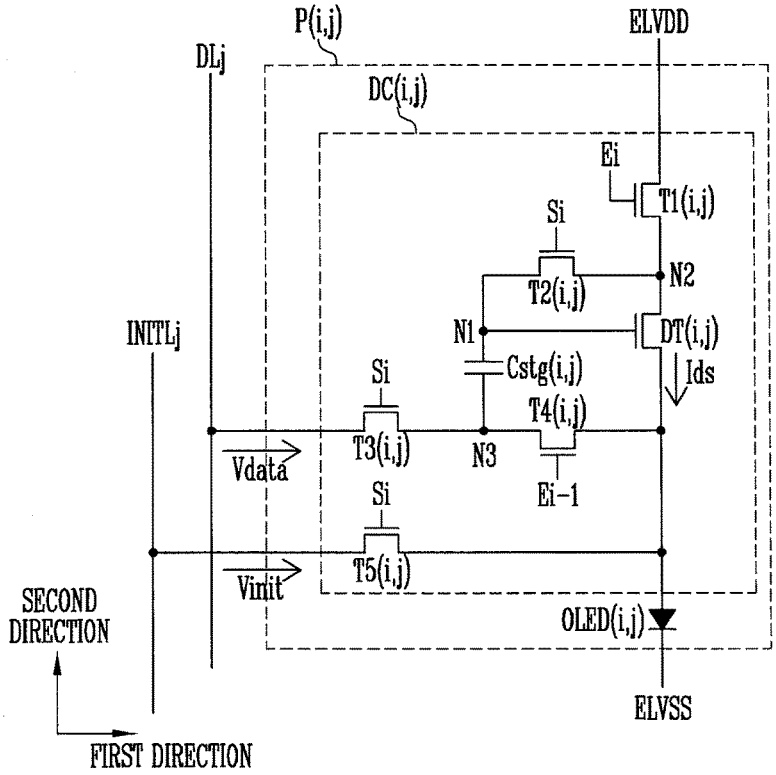
FIG. 2 illustrates an embodiment of a structure of a pixel in the display panel of FIG. 1.

FIG. 2 illustrates an embodiment of a structure of a pixel in the display panel of FIG. 1. For convenience sake, among the pixels P, only a pixel P(i,j) will be described. According to the present embodiment, j may be an odd number.

The pixel P(i,j) includes an organic light emitting diode (OLED) OLED(i,j) and a driving circuit DC(i,j) for supplying a current to the organic light emitting diode OLED(i,j). The driving circuit DC(i,j) includes a driving transistor DT(i,j), first to fifth transistors T1(*i,j*) to T5(*i,j*), and a storage capacitor Cstg(i,j). The organic light emitting diode OLED(i,j) includes an anode electrode and a cathode electrode. The driving transistor DT(i,j) and the first to fifth transistors T1(*i,j*) to T5(*i,j*) may be n-channel type transistors. Because the n-channel type transistors use electrons as a carrier, the n-channel type transistors have a higher response speed when responding to a control signal as compared to p-channel type transistors, which use holes as a carrier. Therefore, the n-channel type transistors are advantageous when used in a large-area display device. The n-channel type transistors are turned on when a high-level voltage is supplied to gate electrodes thereof, and may be turned off when a low-level voltage is supplied to gate electrodes thereof. Hereinafter, supply of the scan signals or the emission control signals may indicate that the scan signals or the emission control signals have high-level voltages, while not supplying the scan signals or the emission control signals may indicate that the scan signals or the emission control signals have low-level voltages. The first to fifth transistors T1(*i,j*) to T5(*i,j*) may be amorphous silicon thin film transistors (a-Si TFT), oxide thin film transistors (oxide TFT), and/or polycrystalline-silicon thin film transistors (poly-Si TFT).

The driving transistor DT(i,j) controls a level of a current that flows to the organic light emitting diode OLED(i,j). The level of the current may be determined based on a level of a voltage Vdata supplied to the data line DLj electrically connected to the pixel P(i,j). A gate electrode of the driving transistor DT(i,j) is electrically connected to a first node N1, a first electrode of the driving transistor DT(i,j) is electrically connected to a second node N2, and a second electrode of the driving transistor DT(i,j) is electrically connected to the anode electrode of the organic light emitting diode OLED(i,j). The first electrode of the driving transistor DT(i,j) may be one of a source electrode and a drain electrode, and the second electrode of the driving transistor DT(i,j) may be the other of the source electrode and the drain electrode. In the present embodiment, the first electrode of the driving transistor DT(i,j) is the drain electrode, and the second electrode is the source electrode. However, the present invention is not limited thereto. That is, whether a first electrode of a transistor is a source electrode or a drain electrode, and whether a second electrode is a source electrode or a drain electrode, may vary. Control by the driving transistor DT(i,j) of the level of the current that flows to the organic light emitting diode OLED(i,j) will be described in detail later.

An ith emission control signal Ei is supplied from an ith emission control line ELi to a gate electrode of the first transistor T1(*i,j*), the first power source ELVDD is supplied to a first electrode of the first transistor T1(*i,j*), and a second electrode of the first transistor T1(*i,j*) is electrically connected to the second node N2. When the first transistor T1(*i,j*) is turned on by supply of the ith emission control signal Ei, the first power source ELVDD is supplied to the second node N2.

An ith scan signal Si is supplied from an ith scan line SLi to a gate electrode of the second transistor T2(*i,j*), a first electrode of the second transistor T2(*i,j*) is electrically connected to the second node N2, and a second electrode of the second transistor T2(*i,j*) is electrically connected to the first node N1. When the second transistor T2(*i,j*) is turned on by supply of the ith scan signal Si, the driving transistor DT(i,j) is diode-connected.

The ith scan signal Si is supplied to a gate electrode of the third transistor T3(*i,j*), the data voltage Vdata is supplied from the jth data line DLj to a first electrode of the third transistor T3(*i,j*), and a second electrode of the third transistor T3(*i,j*) is electrically connected to a third node N3. When the third transistor T3(*i,j*) is turned on by the supply of the ith scan signal Si, the data voltage Vdata is supplied to the third node N3.

An (i−1)th emission control signal Ei−1 is supplied from an (i−1)th emission control line Eli−1 to a gate electrode of the fourth transistor T4(*i,j*), a first electrode of the fourth transistor T4(*i,j*) is electrically connected to the third node N3, a second electrode of the fourth transistor T4(*i,j*) is electrically connected to the anode electrode of the organic light emitting diode OLED(i,j). When the fourth transistor T4(*i,j*) is turned on by supply of the (i−1)th emission control signal Ei−1, the third node N3 is electrically connected to the anode electrode of the organic light emitting diode OLED(i,j). When the emission control signals are sequentially supplied to the emission control lines EL, in the frame period, a time at which the ith emission control signal Ei starts to be supplied is later than a time at which the (i−1)th emission control signal Ei−1 starts to be supplied.

The ith scan signal Si is supplied to a gate electrode of the fifth transistor T5(*i,j*), a first electrode of the fifth transistor T5(*i,j*) is electrically connected to the anode electrode of the organic light emitting diode OLED(i,j), and the initializing power source Vinit is supplied from an initializing power source line INITLj to a second electrode of the fifth transistor T5(*i,j*). When the fifth transistor T5(*i,j*) is turned on by the supply of the ith scan signal Si, the initializing power source Vinit is supplied to the anode electrode of the organic light emitting diode OLED(i,j).

One end of the storage capacitor Cstg(i,j) is electrically connected to the first node N1, and the other end of the storage capacitor Cstg(i,j) is electrically connected to the third node N3. The storage capacitor Cstg(i,j) maintains a voltage difference between the gate electrode and the second electrode of the driving transistor DT(i,j) when the fourth transistor T4(*i,j*) is turned on.

The second power source ELVSS is supplied to the cathode electrode of the organic light emitting diode OLED (i,j). A voltage level of the first power source ELVDD is higher than that of the second power source ELVSS, and is higher than that of the initializing power source Vinit. The voltage level of the initializing power source Vinit may be sufficiently low so that the organic light emitting diode OLED(i,j) does not emit light when the initializing power source Vinit is supplied to the anode electrode of the organic light emitting diode OLED(i,j).

Figure 3:
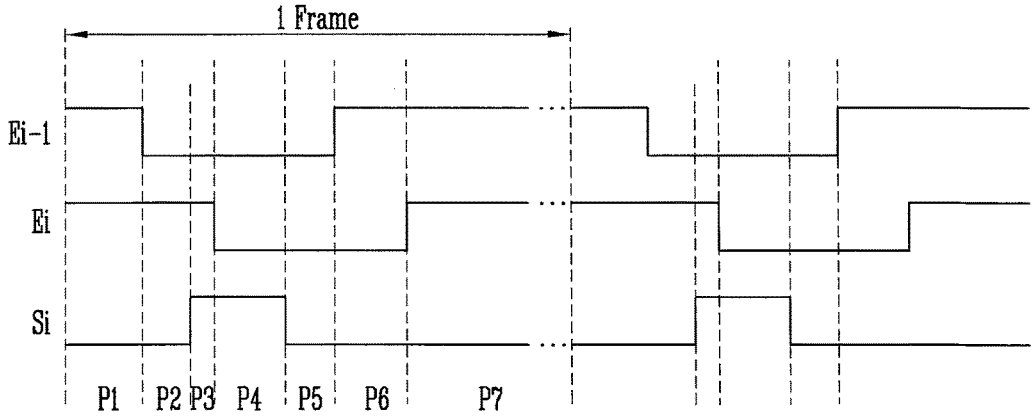
FIG. 3 illustrates waveforms of signals supplied to the pixel of FIG. 2.

FIG. 3 illustrates waveforms of signals supplied to the pixel of FIG. 2.

The single frame period "1 Frame" includes first to seventh periods P1 to P7. When a driving frequency of the display panel 100 is about 60 Hz, the frame period 1 Frame may be about 16.6 ms, and may be determined by the vertical synchronizing signal Vsync.

In the first period P1, the ith emission control signal Ei and the (i−1)th emission control signal Ei−1 are supplied, and the ith scan signal Si is not supplied. The first and fourth transistors T1(*i,j*) and T4(*i,j*) are turned on, and the second, third, and fifth transistors T2(*i,j*), T3(*i,j*), and T5(*i,j*) are turned off. Based on a data voltage in a previous frame, the organic light emitting diode OLED(i,j) emits light.

In the second period P2, the ith emission control signal Ei is supplied, and the ith scan signal Si and the (i−1)th emission control signal Ei−1 are not supplied. The first transistor T1(*i,j*) is turned on, and the second to fifth transistors T2(*i,j*) to T5(*i,j*) are turned off.

In the third period P3, the ith scan signal Si and the ith emission control signal Ei are supplied, and the (i−1)th emission control signal Ei−1 is not supplied. The first, second, third, and fifth transistors T1(*i,j*), T2(*i,j*), T3(*i,j*), and T5(*i,j*) are turned on and the fourth transistor T4(*i,j*) is turned off. Because the first and second transistors T1(*i,j*) and T2(*i,j*) are turned on, the first power source ELVDD is supplied to the first node N1. Although the driving transistor DT(i,j) is diode-connected, due to the supply of the first power source ELVDD, voltages of the first node N1 and the second node N2 do not change. Because the third transistor T3(*i,j*) is turned on, the data voltage Vdata is supplied to the third node N3. Because the fifth transistor T5(*i,j*) is turned on, the initializing power source Vinit is supplied to the anode electrode of the organic light emitting diode OLED (i,j). That is, the organic light emitting diode OLED(i,j) does not emit light. In the third period P3, the first power source ELVDD is supplied to the first node N1. That is, the gate electrode of the driving transistor DT(i,j) is initialized by the first power source ELVDD. The third period P3 corresponds to an initializing process.

In the fourth period P4, the ith scan signal Si is supplied, and the (i−1)th emission control signal Ei−1 and the ith emission control signal Ei are not supplied. The second, third, and fifth transistors T2(*i,j*), T3(*i,j*), and T5(*i,j*) are turned on, and the first and fourth transistors T1(*i,j*) and T4(*i,j*) are turned off. Because the first transistor T1(*i,j*) is turned off (i.e., the first power source ELVDD is not supplied to the first node N1), and because the second transistor T2(*i,j*) is turned on, the driving transistor DT(i,j) is diode-connected, and the voltages of the first node N1 and the second node N2 may change. Because the third transistor T3(*i,j*) is turned on, the data voltage Vdata is supplied to the third node N3. Because the fifth transistor T5(*i,j*) is turned on, the initializing power source Vinit is supplied to the anode electrode of the organic light emitting diode OLED (i,j). That is, the organic light emitting diode OLED(i,j) does not emit light. When the fourth period P4 starts, the voltage level of the second node N2 is the same as that of the first power source ELVDD, and the initializing power source Vinit is supplied to the anode electrode of the organic light emitting diode OLED(i,j). Accordingly, a current flows from the second node N2 to the anode electrode of the organic light emitting diode OLED(i,j). Due to the flow of the current, the voltage levels of the first node N1 and the second node N2 are reduced until the diode-connected driving transistor DT(i,j) is turned off. When a difference in voltage level between the gate electrode and the source electrode (the second electrode) of the driving transistor DT(i,j) is smaller than a threshold voltage of the driving transistor DT(i,j), the driving transistor DT(i,j) is turned off. That is, in the fourth period P4, the voltage level of the first node N1 changes according to the following EQUATION.

$$VN1 = Vinit + Vth \qquad \text{EQUATION 1}$$

wherein VN1 represents the voltage level of the first node N1, Vinit represents the voltage level of the initializing power source Vinit, and Vth represents the threshold voltage of the driving transistor DT(i,j).

Because the ends of the storage capacitor Cstg(i,j) are respectively electrically connected to the first node N1 and the third node N3, a difference in voltage level between the ends of the storage capacitor Cstg(i,j) may be defined by the following EQUATION.

$$Vstg = (Vinit + Vth) - Vdata \qquad \text{EQUATION 2}$$

wherein Vstg represents the difference in voltage level between the ends of the storage capacitor Cstg(i,j), Vinit represents the voltage level of the initializing power source Vinit, Vth represents the threshold voltage of the driving transistor DT(i,j), and Vdata represents the level of the data voltage Vdata. That is, the difference in voltage level between the both ends of the storage capacitor Cstg(i,j) includes the threshold voltage Vth of the driving transistor DT(I,j). The fourth period P4 corresponds to a threshold voltage compensating process.

In the fifth period P5, the ith scan signal Si, the (i−1)th emission control signal Ei−1, and the ith emission control signal Ei are not supplied. Because the first to fifth transistors T1(*i,j*) to T5(*i,j*) are turned off, there is no change, and the difference in voltage level between the ends of the storage capacitor Cstg(i,j) is maintained. Although the initializing power source Vinit is not supplied to the anode electrode of the organic light emitting diode OLED(i,j), because the first transistor T1(*i,j*) is turned off, the organic light emitting diode OLED(i,j) does not emit light.

In the sixth period P6, the (i−1)th emission control signal Ei−1 is supplied, and the ith scan signal Si and the ith emission control signal Ei are not supplied. The fourth transistor T4(*i,j*) is turned on and the first, second, third, and fifth transistors T1(*i,j*), T2(*i,j*), T3(*i,j*), and T5(*i,j*) are turned off. Although the initializing power source Vinit is not supplied to the anode electrode of the organic light emitting diode OLED(i,j), because the first transistor T1(*i,j*) is turned off, the organic light emitting diode OLED(i,j) does not emit light. Because the fourth transistor T4(*i,j*) is turned on, the third node N3 is electrically connected to the anode electrode of the organic light emitting diode OLED(i,j). Because the first node N1 is floated by turning-off of the second transistor T2(*i,j*), although the fourth transistor T4(*i,j*) is turned on, the difference in voltage level Vstg between the ends of the storage capacitor Cstg(i,j) does not change. Because the third node N3 is electrically connected to the second electrode of the driving transistor DT(i,j) by turning on the fourth transistor T4(*i,j*), a difference in voltage level between the gate electrode and the second electrode of the driving transistor DT(i,j) is equal to the difference in voltage level between the ends of the storage capacitor Cstg(i,j), which may be defined by the EQUATION 2.

In the seventh period P7, the (i−1)th emission control signal Ei−1 and the ith emission control signal Ei are supplied, and the ith scan signal Si is not supplied. The first and fourth transistors T1(*i,j*) and T4(*i,j*) are turned on, and the second, third, and fifth transistors T2(*i,j*), T3(*i,j*), and T5(*i,j*) are turned off. The first transistor T1(*i,j*) is turned on so that the first power source ELVDD is supplied to the second node N2. The fifth transistor T5(*i,j*) is turned off so that the initializing power source Vinit is not supplied to the anode electrode of the organic light emitting diode OLED (i,j). Therefore, the organic light emitting diode OLED(i,j) emits light again.

The level of the current that flows to the organic light emitting diode OLED(i,j) is the same as a level of a current Ids that flows between the first electrode and the second electrode of the driving transistor DT(i,j). The current level Ids is defined by the following EQUATION.

$$Ids=k(Vgs-Vth)^2=k\{(Vinit+Vth)-Vdata-Vth\}^2=k(Vinit-Vdata)^2 \quad \text{EQUATION 3}$$

wherein Ids represents the level of the current that flows between the first electrode and the second electrode of the driving transistor DT(i,j), k represents a proportional constant, Vgs represents the difference in voltage level between the gate electrode and the second electrode of the driving transistor DT(i,j), Vinit represents the voltage level of the initializing power source Vinit, Vth represents the threshold voltage of the driving transistor DT(i,j), and Vdata represents the level of the data voltage Vdata.

As defined in the EQUATION 3, the level Ids of the current that flows between the first electrode and the second electrode of the driving transistor DT(i,j) is independent of the threshold voltage Vth of the driving transistor DT(i,j). Because brightness of the light emitted by the organic light emitting diode OLED(i,j) is proportional to the current level Ids, it is possible to confirm that the threshold voltage Vth of the driving transistor DT(i,j) is appropriately compensated for when the pixel P(i,j) is driven.

Figure 4:
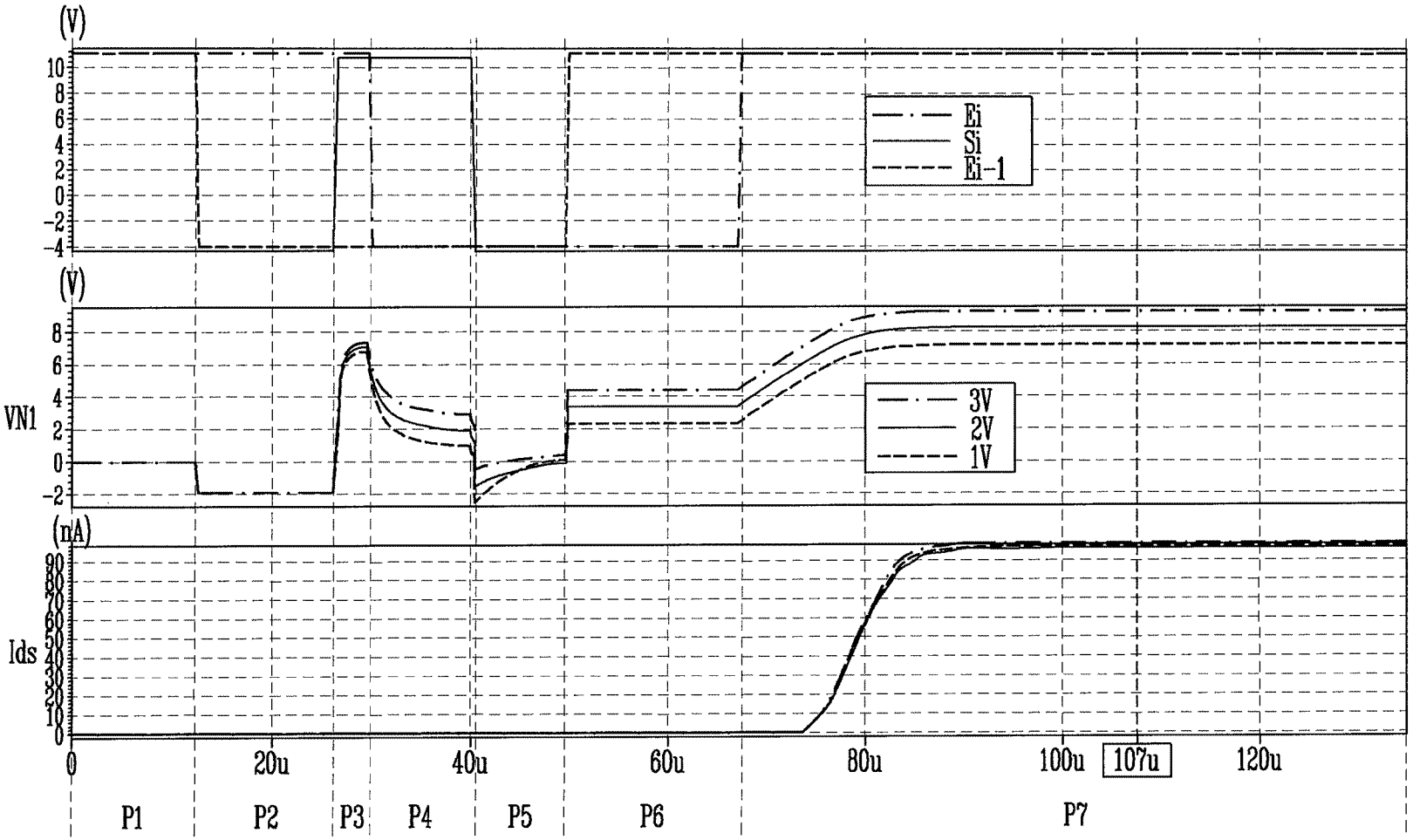
FIG. 4 illustrates simulation results in which a threshold voltage is compensated for when the signals of FIG. 3 are supplied to the pixel of FIG. 2.

FIG. 4 illustrates simulation results in which a threshold voltage is compensated when the signals of FIG. 3 are supplied to the pixel of FIG. 2.

In FIG. 4, the case in which the threshold voltage of the driving transistor DT(i,j) is 3V, the case in which the threshold voltage of the driving transistor DT(i,j) is 2V, and the case in which the threshold voltage of the driving transistor DT(i,j) is 1V, will be compared. The (i−1)th emission control signal Ei−1, the ith emission control signal Ei, and the ith scan signal Si previously described in FIG. 3 are input in the same way in the above three cases. Although not shown in FIG. 4, the levels of the data voltage Vdata are the same in the above three cases.

In the fourth period P4, the first node N1 has different voltage levels in the above three cases, and differences in voltage level are maintained in the fifth to seventh periods P5 to P7. That is, in the fourth period P4, as defined in the EQUATION 1, it is noted that the voltage VN1 of the first node N1 compensates for the threshold voltage Vth.

The levels of the current Ids that flows between the first electrode and the second electrode of the driving transistor DT(i,j) are very similar in the above three cases. That is, as defined in the EQUATION 3, it is noted that the level of the current Ids that flows between the first electrode and the second electrode of the driving transistor DT(i,j) is independent of the threshold voltage Vth of the driving transistor DT(i,j).

FIG. 5 illustrates that pixels of the organic light emitting display device of FIG. 1 share a transistor and an initializing power source line.

In FIG. 5, pixels P(i,j)', P(i,j−1)', and P(i,j+1)' are displayed. Because the pixel P(i,j)' is the same as the pixel P(i,j) of FIG. 2, detailed description thereof will not be repeated.

In the pixel P(i,j)', a first electrode of a first transistor T1(*i,j*)' is electrically connected to a (j+1)th first power source line VDDLj+1' among the first power source lines VDDL. The first power source ELVDD is supplied to the first electrode of the first transistor T1(*i,j*)' of the pixel P(i,j)'.

The pixel P(i,j+1)' is not directly connected to the (j+1)th first power source line VDDLj+1'. The first power source ELVDD is supplied to the pixel P(i,j+1)' only when the first transistor T1(*i,j*)' of the pixel P(i,j)' is turned on. That is, the pixel P(i,j+1)' adjacent to the pixel P(i,j)' in the first direction receives the first power source ELVDD through the first transistor T1(*i,j*)' of the pixel P(i,j)'.

The display panel 100 having the pixel structure of FIG. 5 may transmit the first power source ELVDD to two driving transistors DT(i,j) and DT(i,j+1) by using the (j+1)th first power source line VDDLj+1' and the first transistor T1(*i,j*)'. In this case, because an area occupied by the transistors and the first power source lines VDDL is reduced in comparison with the case in which adjacent pixels in the first direction receive the first power source using different first power source lines and different first transistors, it is advantageous to implementing a display panel having high resolution.

In the pixel (i,j)', a second electrode of a fifth transistor T5(*i,j*)' is electrically connected to a jth initializing power source line INITLj' among the initializing power source lines. The initializing power source Vinit is supplied to the second electrode of the fifth transistor T5(*i,j*)'.

In the pixel P(i,j−1)', a second electrode of a fifth transistor T5(*i,j*−1)' is electrically connected to the jth initializing power source line INITLj' among the initializing power source lines INITL. That is, the initializing power source line INITLj' supplying the initializing power source Vinit to the pixel P(i,j)' also supplies the initializing power source Vinit to the pixel P(i,j−1)' that is adjacent the pixel P(i,j)' in a direction opposite to the first direction.

The display panel 100 having the pixel structure of FIG. 5 may transmit the initializing power source Vinit to two organic light emitting diodes OLED(i,j) and OLED(i,j−1) by using the jth initializing power source line INITLj'. In this case, because an area occupied by the initializing power source lines INITL is reduced in comparison with the case in which the adjacent pixels in the first direction receive the initializing power source by using different initializing power source lines, it is advantageous to implementing a display panel having high resolution.

Figure 6:
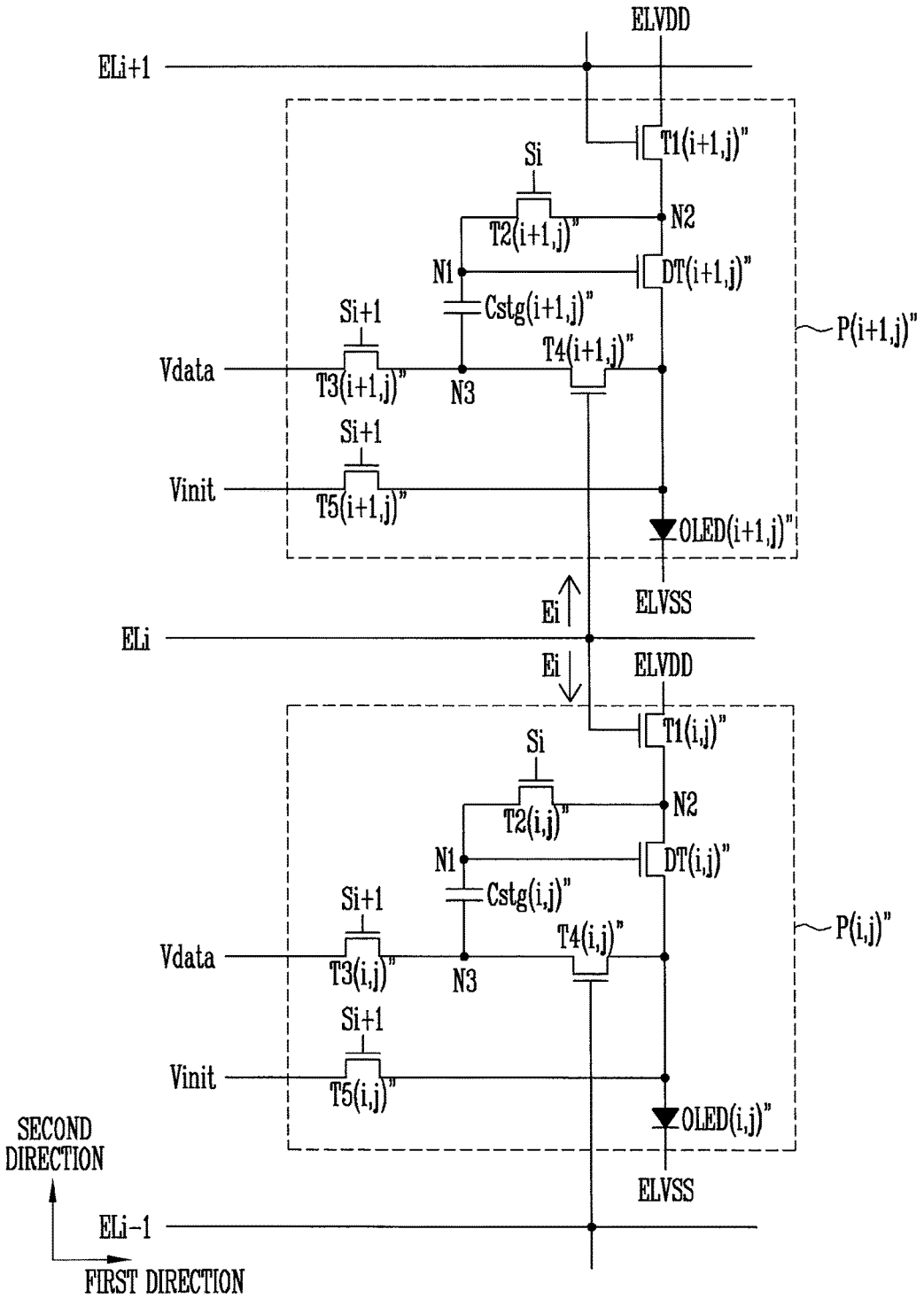
FIG. 6 illustrates pixels of the organic light emitting display device of FIG. 1 sharing an emission control line.

FIG. 6 illustrates that pixels of the organic light emitting display device of FIG. 1 share an emission control line. In FIG. 6, pixels P(i,j)" and P(i+1,j)" are displayed. Because the pixel P(i,j)" corresponds to the pixel P(i,j) of FIG. 2, detailed description thereof will not be repeated.

In the pixel P(i,j)", the ith emission control signal Ei is supplied to a gate electrode of a first transistor T1(*i,j*)". However, in the pixel P(i+1,j)", the ith emission control signal Ei is supplied to a gate electrode of a fourth transistor T4(*i*+1,j)". The emission control line ELi supplying the ith emission control signal Ei to the gate electrode of the first transistor T1(*i,j*)" of the pixel P(i,j)" also supplies the ith emission control signal Ei to the gate electrode of the fourth transistor T4(*i*+1,j)" adjacent the pixel P(i,j)" in the second direction.

The display panel 100 having the pixel structure of FIG. 6 may transmit the ith emission control signal Ei to the gate electrode of the first transistor T1(*i,j*)" of the pixel P(i,j)" and the gate electrode of the fourth transistor T4(*i*+1,j)" of the pixel P(i+1,j)" by using the ith emission control line ELi. In this case, because an area occupied by the emission control lines EL is reduced in comparison with the case in which pixels adjacent each other in the second direction receive the emission control signals by using additional emission control lines, it is advantageous to implementing a display panel having high resolution.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. A pixel comprising:

an organic light emitting diode comprising an anode electrode, and a cathode electrode configured to receive a second power source; and a driving circuit configured to supply a current to the organic light emitting diode, the driving circuit comprising:

a driving transistor comprising a gate electrode electrically connected to a first node, a first electrode electrically connected to a second node, and a second electrode electrically connected to the anode electrode of the organic light emitting diode;

a first transistor directly coupled between the driving transistor and a first power source, configured to supply the first power source to the second node, and comprising a gate electrode configured to receive a first emission control signal, a first electrode configured to receive the first power source, and a second electrode electrically connected to the second node;

a second transistor comprising a gate electrode configured to receive a scan signal, a first electrode electrically connected to the second node, and a second electrode electrically connected to the first node;

a third transistor comprising a gate electrode configured to receive the scan signal, a first electrode configured to receive a data voltage, and a second electrode electrically connected to a third node;

a fourth transistor comprising a gate electrode configured to receive a second emission control signal that is different from the first emission control signal, a first electrode electrically connected to the third node, and a second electrode electrically connected to the anode electrode of the organic light emitting diode;

a fifth transistor comprising a gate electrode configured to receive the scan signal, a first electrode electrically connected to the anode electrode of the organic light emitting diode, and a second electrode configured to receive an initializing power source; and a storage capacitor electrically connected between the first node and the third node.

2. The pixel of claim 1, wherein the driving transistor, and the first, second, third, fourth, and fifth transistors comprise n-channel type transistors.

3. The pixel of claim 1, wherein a length of the first emission control signal is substantially equal to a length of the second emission control signal in a frame period, wherein the frame period comprises first to seventh periods, wherein the first emission control signal has a high level in the first, second, third, and seventh periods, and has a low level in the fourth, fifth, and sixth periods, wherein the second emission control signal has a high level in the first, sixth, and seventh periods, and has a low level in the second, third, fourth, and fifth periods, wherein the scan signal has a high level in the third and fourth periods, and has a low level in the first, second, fifth, sixth, and seventh periods, and wherein the organic light emitting diode is configured to emit light in the first, second, and seventh periods.

4. The pixel of claim 3, wherein the first, second, third, and fifth transistors are configured to be turned on, and the fourth transistor is configured to be turned off, in the third period, and wherein the first node is configured to receive the first power source in the third period.

5. The pixel of claim 3, wherein the second, third, and fifth transistors are configured to be turned on, and the first and fourth transistors are configured to be turned off, in the fourth period, wherein the first node and the second node are configured to be electrically connected so that the driving transistor is diode-connected in the fourth period, and wherein a difference in a voltage level between ends of the storage capacitor corresponds to following EQUATION:

$$Vstg=(V\text{init}+Vth)-V\text{data}$$

wherein Vstg represents the difference in the voltage level between the ends of the storage capacitor, Vinit represents a voltage level of the initializing power source, Vth represents a threshold voltage of the driving transistor, and Vdata represents a level of the data voltage.

6. The pixel of claim 3, wherein the first and fourth transistors are configured to be turned on, and the second, third, and fifth transistors are configured to be turned off, in the seventh period, wherein the third node and the anode electrode of the organic light emitting diode are configured to be electrically connected in the seventh period, and wherein a level of a current that flows between the first electrode and the second electrode of the driving transistor corresponds to following EQUATION:

$$Ids=k(Vgs-Vth)^2=k\{(V\text{init}+Vth)-V\text{data}-Vth\}^2=k(V\text{init}-V\text{data})^2$$

wherein Ids represents the level of the current that flows between the first electrode and the second electrode of the driving transistor, k represents a proportional constant, Vgs represents a difference in voltage level between the gate electrode and the second electrode of the driving transistor, Vinit represents a voltage level of the initializing power source, Vth represents a threshold voltage of the driving transistor, and Vdata represents a level of the data voltage.

7. An organic light emitting display device comprising:

a display panel; and a display panel driver configured to drive the display panel, the display panel comprising:

pixels;

m (m is a natural number greater than 1) scan lines configured to transmit scan signals to the pixels;

(m+1) emission control lines configured to transmit emission control signals to the pixels; and n (n is a natural number) data lines configured to transmit data voltages to the pixels, wherein the display panel driver comprises:

a data driver configured to generate the data voltages based on received image signals; and a signal driver configured to generate the scan signals and the emission control signals, wherein a pixel of the pixels that is at an ith (i is a natural number less than or equal to m) row comprises:

an organic light emitting diode comprising an anode electrode, and a cathode electrode configured to receive a second power source;

a driving transistor comprising a gate electrode electrically connected to a first node, a first electrode electrically connected to a second node, and a second electrode electrically connected to the anode electrode of the organic light emitting diode;

a first transistor directly coupled between the driving transistor and a first power source, configured to supply the first power source to the second node, and comprising a gate electrode configured to receive a first emission control signal, a first electrode configured to receive the first power source, and a second electrode electrically connected to the second node;

a second transistor comprising a gate electrode configured to receive a scan signal, a first electrode electrically connected to the second node, and a second electrode electrically connected to the first node;

a third transistor comprising a gate electrode configured to receive the scan signal, a first electrode configured to receive a data voltage, and a second electrode electrically connected to a third node;

a fourth transistor comprising a gate electrode configured to receive a second emission control signal that is different from the first emission control signal, a first electrode electrically connected to the third node, and a second electrode electrically connected to the anode electrode of the organic light emitting diode;

a fifth transistor comprising a gate electrode configured to receive the scan signal, a first electrode electrically connected to the anode electrode of the organic light emitting diode, and a second electrode configured to receive an initializing power source; and a storage capacitor electrically connected between the first node and the third node.

8. The organic light emitting display device of claim 7, wherein a frame period comprises first to seventh periods, wherein an ith emission control signal has a high level in the first, second, third, and seventh periods, and has a low level in the fourth, fifth, and sixth periods, wherein an (i−1)th emission control signal has a high level in the first, sixth, and seventh periods, and has a low level in the second, third, fourth, and fifth periods, wherein an ith scan signal has a high level in the third and fourth periods and has a low level in the first, second, fifth, sixth, and seventh periods, and wherein the organic light emitting diode is configured to emit light only in the first, second, and seventh periods.

9. The organic light emitting display device of claim 8, wherein the second, third, and fifth transistors are configured to be turned on, and the first and fourth transistors are configured to be turned off, in the fourth period, wherein the first node and the second node are configured to be electrically connected so that the driving transistor is diode-connected in the fourth period, and wherein a difference in a voltage level between ends of the storage capacitor corresponds to following EQUATION:

$$Vstg=(V\text{init}+Vth)-V\text{data}$$

wherein Vstg represents the difference in the voltage level between the ends of the storage capacitor, Vinit represents a voltage level of the initializing power source, Vth represents a threshold voltage of the driving transistor, and Vdata represents a level of the data voltage.

10. The organic light emitting display device of claim 8, wherein the first and fourth transistors are configured to be turned on, and the second, third, and fifth transistors are configured to be turned off, in the seventh period, wherein the third node and the anode electrode of the organic light emitting diode are configured to be electrically connected in the seventh period, and wherein a level of a current that flows between the first electrode and the second electrode of the driving transistor corresponds to following EQUATION:

$$Ids=k(Vgs-Vth)^2=k\{(V\text{init}+Vth)-V\text{data}-Vth\}^2=k(V\text{init}-V\text{data})^2$$

wherein Ids represents the level of the current that flows between the first electrode and the second electrode of the driving transistor, k represents a proportional constant, Vgs represents a difference in voltage level between the gate electrode and the second electrode of the driving transistor, Vinit represents a voltage level of the initializing power source, Vth represents a threshold voltage of the driving transistor, and Vdata represents a level of the data voltage.

11. The organic light emitting display device of claim 7, further comprising a power source supplier configured to generate the first power source and the initializing power source, wherein the display panel further comprises first power source lines configured to transmit the first power source to the pixels, and initializing power source lines configured to transmit the initializing power source to the pixels, wherein the pixels are arranged in a first direction, and in a second direction that intersects the first direction, wherein lengths of the emission control signals are substantially constant in a frame period, wherein the scan lines and the emission control lines extend in the first direction, wherein the scan signals or the emission control signals are sequentially supplied in the second direction in the frame period, and wherein the first power source lines and the initializing power source lines extend in the second direction.

12. The organic light emitting display device of claim 11, wherein a first electrode of the first transistor is electrically connected to one of the first power source lines, and wherein a pixel adjacent the pixel in the ith row in the first direction is configured to receive the first power source through the first transistor of the pixel in the ith row.

13. The organic light emitting display device of claim 11, wherein an initializing power source line configured to supply the initializing power source to the pixel in the ith row is configured to supply the initializing power source to a pixel adjacent the pixel in the ith row in a direction opposite to the first direction.

14. The organic light emitting display device of claim 11, wherein a structure of the pixel in the ith row is substantially equal to a structure of a pixel adjacent the pixel in the ith row in the second direction, and wherein an emission control line of the emission control lines is configured to supply an ith emission control signal to the gate electrode of the first transistor of the pixel in the ith row, and is configured to supply the ith emission control signal to a gate electrode of a fourth transistor of the pixel adjacent the pixel in the ith row in the second direction.

15. A method of driving a pixel comprising:

an organic light emitting diode comprising an anode electrode, and a cathode electrode configured to receive a second power source; and a driving transistor comprising a gate electrode electrically connected to a first node, a first electrode electrically connected to a second node, and a second electrode electrically connected to the anode electrode of the organic light emitting diode;

a first transistor comprising a gate electrode configured to receive a first emission control signal, a first electrode configured to receive a first power source, and a second electrode electrically connected to the second node, the first transistor being directly coupled between the driving transistor and the first power source;

a second transistor comprising a gate electrode configured to receive a scan signal, a first electrode electrically connected to the second node, and a second electrode electrically connected to the first node;

a third transistor comprising a gate electrode configured to receive the scan signal, a first electrode configured to receive a data voltage, and a second electrode electrically connected to a third node;

a fourth transistor comprising a gate electrode configured to receive a second emission control signal that is different from the first emission control signal, a first electrode electrically connected to the third node, and a second electrode electrically connected to the anode electrode of the organic light emitting diode;

a fifth transistor comprising a gate electrode configured to receive the scan signal, a first electrode electrically connected to the anode electrode of the organic light emitting diode, and a second electrode configured to receive an initializing power source; and a storage capacitor electrically connected between the first node and the third node, wherein the method comprises:

supplying the scan signal and the first emission control signal to supply the first power source to the first node;

supplying the scan signal to diode-connect the driving transistor, and not supplying the first emission control signal to block the first power source from the driving transistor; and supplying the first emission control signal and the second emission control signal so that the organic light emitting diode emits light.

16. The method of claim 15, wherein a length of the first emission control signal is substantially equal to a length of the second emission control signal in a frame period, and wherein a time at which the first emission control signal starts to be supplied is later than a time at which the second emission control signal starts to be supplied in the frame period.

17. The method of claim 15, wherein the supplying the scan signal to diode-connect the driving transistor, and not supplying the first emission control signal to block the first power source from the driving transistor, comprise:

turning on the second, third, and fifth transistors;

turning off the first and fourth transistors; and electrically connecting the first node and the second node, and wherein a difference in voltage level between ends of the storage capacitor corresponds to following EQUATION:

$$Vstg=(V\text{init}+Vth)-V\text{data}$$

wherein Vstg represents the difference in voltage level between the ends of the storage capacitor, Vinit represents a voltage level of the initializing power source, Vth represents a threshold voltage of the driving transistor, and Vdata represents a level of the data voltage.

18. The method of claim 15, wherein the supplying the first emission control signal and the second emission control signal so that the organic light emitting diode emits light comprises:

turning on the first and fourth transistors;

turning off the second, third, and fifth transistors; and electrically connecting the third node and the anode electrode of the organic light emitting diode, wherein a level of a current that flows between the first electrode and the second electrode of the driving transistor corresponds to following EQUATION:

$$Ids=k(Vgs-Vth)^2=k\{(V\text{init}+Vth)-V\text{data}-Vth\}^2=k(V\text{init}-V\text{data})^2$$

wherein Ids represents the level of the current that flows between the first electrode and the second electrode of the driving transistor, k represents a proportional constant, Vgs represents a difference in voltage level between the gate electrode and the second electrode of the driving transistor, Vinit represents a voltage level of the initializing power source, Vth represents a threshold voltage of the driving transistor, and Vdata represents a level of the data voltage.

* * * * *